United States Patent [19]

Omran et al.

[11] 4,430,194

[45] Feb. 7, 1984

[54] METHOD FOR THE PRODUCTION OF A HIGHLY AROMATIC PITCH-LIKE COAL BY-PRODUCT

[75] Inventors: Jafar Omran; Karl-Heinz Koch, both of Castrop-Rauxel, Fed. Rep. of Germany

[73] Assignee: Rutgerswerke Aktiengesellschaft, Frankfurt, Fed. Rep. of Germany

[21] Appl. No.: 289,936

[22] Filed: Aug. 4, 1981

[30] Foreign Application Priority Data

Sep. 4, 1980 [DE] Fed. Rep. of Germany ..... 3033228

[51] Int. Cl.[3] ..... C10G 1/00; C10G 73/00

[52] U.S. Cl. ..... 208/8 LE; 208/23

[58] Field of Search ..... 208/8 LE, 23

[56] References Cited

U.S. PATENT DOCUMENTS

| | | | |
|---|---|---|---|
| 3,966,585 | 6/1976 | Gray et al. | 208/8 LE |
| 4,040,941 | 8/1977 | Yamoda et al. | 208/8 LE |
| 4,119,525 | 10/1978 | Gray et al. | 208/8 LE |

*Primary Examiner*—William G. Wright

*Attorney, Agent, or Firm*—Beveridge, DeGrandi & Kline

[57] ABSTRACT

An improvement in the method for the production of a highly aromatic pitch-like coal by-product by dissolving comminuted coal or similar solid carbon-containing raw materials with aromatic solvents at elevated temperature is disclosed wherein the solid materials are dissolved at atmospheric pressure in aromatic compound mixtures of coal origin with an average boiling point above 350° C. and recycling of the condensable fractions of the reaction gas. If the occasion arises, further aromatic solvents may be added to the suspension.

8 Claims, No Drawings

METHOD FOR THE PRODUCTION OF A HIGHLY AROMATIC PITCH-LIKE COAL BY-PRODUCT

The present invention relates to an improved method for the production of a highly aromatic coal-tar pitch-like coal by-product by dissolving comminuted coal or similar solid carbon-containing raw materials by treatment with high-boiling aromatic solvents at an elevated temperature.

Due to the shortage of petroleum and natural gas, which is increasing in the long term, the coal available in abundance in many industrial nations is increasingly gaining significance as a raw material. Moreover, the tendency towards conversion of heavy mineral oil fractions to gasoline and light fuel oil is increasing. From this results a great need for technologies by which the production of substitute products for residues of petroleum origin, which are in particular suitable as raw materials for the production of carbon products, is possible.

On a coal-origin basis, extraction methods have for a long time been proposed for ash removal and liquefaction of coal in order to produce products of this kind. In these methods, the coal is brought into intimate contact with a solvent at an elevated pressure of more than 10 bars and at elevated temperature. The reaction product is separated from the residue of high ash content, and the coal extract of low ash content can then be used as a high-quality raw material after adjustment of suitable flow properties (viscosity, softening point) for the production of carbon products, e.g. electrodes or carbon fibers.

As solvents for coal, hydrocarbon mixtures with available hydrogen are proposed in particular. Solvents of this kind, such as Tetralin (i.e. tetrahydronaphthalene) or hydrogenated anthracene oil, are in a position to convert large proportions of the coal to soluble form. The solution is thereby usually described in technical literature as the quinoline-soluble proportion of the coal used (G. O. Davies et al., Journal of the Inst. of Fuel, Sept. 1977, page 121). According to this, when 3 parts solvent and one part coal are used with application of pressure and elevated temperature, according to the type of coal, up to 90% of the coal used can be converted to quinoline-soluble form.

In technical processes of coal hydrogenation or extraction, on the other hand, operations are preferably carried out with lower oil/coal ratios. In the hydrogenating methods, an oil/coal ratio of 2:1 is used therefor. The methods working with hydrogenated aromatic compounds however have the disadvantage that for the production of the hydroaromatic compounds, an elaborate hydrogenating stage must be conducted before actual coal extraction.

With other solvents, such as residues from mineral oil processing or the traditionally used anthracene oil, the extraction yields which are obtained with the hydrogenated aromatic compound mixtures at the high pressures and temperatures quoted in the literature can be achieved only if hydrogenation is carried out with hydrogen in addition. A further disadvantage of these methods is to be seen in that to carry them out, special pressure-resistant apparatuses are necessary which critically affect the economy of the known methods.

Accordingly, it is an object of the present invention to provide an improved method for dissolving solid carbon-containing materials by the use of solvents with a high solvation capacity in order to obtain aromatic pitch-like raw materials in high yields from these materials by extraction with solvents under particularly mild pressure and temperature conditions and without hydrogenation.

According to the invention, this object is achieved with a method for the production of a highly aromatic pitch-like coal by-product by dissolving comminuted or pulverized coal or similar solid carbon-containing raw materials with aromatic solvents and an elevated temperature, characterized by the fact that these solid materials are dissolved at atmospheric pressure using mixtures of aromatic compounds of coal origin having a mean boiling point above 350° C. and, if necessary, with the addition of further aromatic solvents, and recycling of the condensable fractions of the reaction gas.

With this method, 20–50% by weight of comminuted coal is mixed with 30–80% by weight of very high-boiling aromatic compound mixtures, if necessary with the addition of 10–35% by weight of further aromatic solvents of coal or mineral oil origin, and treated for from 1 to 3 hours at 280° to 380° C. at atmospheric pressure. The vapors which arise are condensed and can be recycled to the process. The method according to the invention may be carried out for example in ordinary heated agitator retorts provided with a reflux condenser. Reaction times of less than 1 hour reduce the proportion of dissolved coal considerably. Reaction times longer than three hours on the other hand do not produce any further increase in yield.

The reaction product can be separated by the known technologies, such as filtration, distillation or promoter-accelerated settling, into a coal extract of low ash content which is suitable for the production of carbon products such as electrode coke, binders and carbon fibers, and a residue of high mineral content. Adjustment of the flow properties of the reaction product is possible without difficulty by aromatic compound mixtures of tar origin, such as for example a coal tar fraction with a boiling range between 240° and 280° C., so called wash oil or anthracene oil.

The kind of coal is variable over a wide range, but preferably mineral coals with a higher volatility content, such as bituminous coals conntaining more than 30% volatile matter, are used as raw materials. These coals represent the majority of all coal deposits; they are little suited to the production of mineral coal coke. However, low-volatile coals such as non-coking or semi-bituminous coals or other carbon-containing raw materials such as lignites or peat also can be used. The degree of comminution is of subordinate importance in this process; preferably coal in a pulverized form is used.

According to the invention, aside from standard coal tar pitch, above all distillates from further processing thereof are used as very high boiling aromatic solvents. But in particular distillates which are obtained in the heat/pressure treatment of coal-tar pitch or in the carbonization of hard pitch are used.

Coal-tar pitch is obtained in the primary distillation of coal tar in a quantity of 50–55% with a softening point of 65°–75° C. (Krämer-Sarnow). Pitches which soften in this temperature range are however not directly suitable for use as carbon initial products such as electrode binders, hard pitch or pitch coke, but are refined for this purpose by known methods by heat/pressure treatment as taught, for example, in U.S. Pat. No. 2,985,577.

High-boiling hydrocarbon mixtures of high aromaticity are obtained as distillates in these processes. These hydrocarbon mixtures have a mean boiling point higher than 350° C. and consequently clearly boil above the anthracene oil fractions usually recommended for coal extraction. Preferably, aromatic compound mixtures of coal origin with a boiling range of 350° to 500° C. are used.

These distillates are available only in a limited quantity and standard pitches, owing to further processing thereof into electrode binder pitches, are likewise not available to an unlimited extend. Therefore other suitable solvents including filtered anthracene oil and aromatic residues from cracking and distillation processes of petroleum refining are used. Preferably, these solvents are aromatic tar oils boiling below 350° C. These further solvents can be used in combination with the very high boiling aromatic compound mixtures of coal origin.

Surprisingly, it has been found that the degree of coal digestion was appreciably higher with this improved pressureless method with complete recycling of the condensable fractions of the reaction gases, than with comparable methods with elevated pressure.

In Examples 1 to 5 is described the method according to the invention. Example 6 is a comparative example which indicates the advantage of the pressureless method compared with the method at elevated pressure.

The results are compiled in the table following the description of the examples. They provide a general view of the efficiency of the different solvents.

EXAMPLE 1

34 parts by weight pulverized bituminous coal of the type "Westerholt" (ash content 6.5%, volatile content, dry ash free, 38.5%) are dissolved in 66 parts by weight pitch distillate from the heat/pressure treatment of standard coal-tar pitch (mean boiling point 420° C.) under reflux at atmospheric pressure and 350° C. while agitating. The reaction time amounts to 2 hours.

In the pitch-like coal by-product thus obtained, with a softening point of 82° C. (Krämer-Sarnow), the coal is digested, i.e. converted to quinoline-soluble form, to the extend of 81%.

EXAMPLE 2

Example 1 is repeated with the exception that a mixture of 33 parts by weight pitch distillate from the heat/pressure treatment of standard coal-tar pitch and 33 parts by weight filtered anthracene oil (boiling range 300° to 385° C.) is used as solvent.

The pitch-like coal by-product thus obtained has a softening point of 78° C. (Krämer-Sarnow). The degree of coal digestion amounts to 79%.

EXAMPLE 3

Example 1 is repeated with the exception that a mixture of 33 parts by weight pitch distillate from the heat/pressure treatment of standard coal-tar pitch and 33 parts by weight highly aromatic residual oil from naphtha pyrolysis (initial boiling point 207° C.) is used as solvent.

A pitch-like coal by-product with a softening point of 126° C. (Krämer-Sarnow) is obtained. The coal was digested to the extent of 77%.

EXAMPLE 4

Example 1 is repeated with the exception that a mixture of 33 parts by weight pitch distillate from the heat/pressure treatment of standard coal-tar pitch and 33 parts by weight residual oil from the catalytic cracking of heavy gas oil (aromaticity=76%, initial boiling point 210° C.) is used as solvent.

The softening point of the pitch-like coal by-product is 117° C. (Krämer-Sarnow) and the degree of coal digestion is 63%.

EXAMPLE 5

33 parts by weight standard coal-tar pitch (softening point 63° C.) are melted at 180° C. in 33 parts by weight filtered anthracene oil (boiling range 300° to 385° C.). In this solvent mixture are dissolved 34 parts by weight "Westerholt"- coal as in Example 1.

The pitch-like coal by-product has a softening point of 110° C. The degree of coal digestion amounts to 68%.

COMPARATIVE EXAMPLE 6

34 parts by weight "Westerholt"-coal as in Example 1 described are treated with 66 parts by weight pitch distillate from the heat/pressure treatment of coal-tar pitch with a mean boiling point of 420° C., at 350° C. with good intermixing during a reaction period of 2 hours. The maximum reaction pressure amount to 13 bars. In the coal by-product thus obtained with a softening point of 82° C. (Krämer-Sarnow), the coal is digested to the extent of only 61%.

In the foregoing examples and throughout the specification and claims, all parts and percentages are by weight unless otherwise specified.

TABLE

| | | Properties of Coal By-Products | | | | | | |
|---|---|---|---|---|---|---|---|---|
| Example | Solvent | Yield (%) | SP(KS) (°C.) | TI (%) | QI (%) | Coke(BM) (%) | Ash (%) | Degree of coal digestion (%) |
| 1 | Pitch distillate | 97.3 | 82 | 31.1 | 7.6 | 24.7 | 2.40 | 81 |
| 2 | Pitch distillate; filtered anthracene oil | 97.0 | 78 | 31.8 | 8.3 | 23.7 | 2.35 | 79 |
| 3 | Pitch distillate; residual oil from naphtha pyrolysis | 97.0 | 126 | 37.9 | 8.8 | 28.8 | 2.41 | 77 |
| 4 | Pitch distillate; residual oil from catalytic gas oil cracking | 97.1 | 117 | 38.1 | 13.1 | 33.0 | 2.35 | 63 |
| 5 | Standard coal-tar pitch; filtered anthracene oil | 97.0 | 110 | 39.3 | 11.6 | 33.8 | 2.40 | 68 |
| 6 Comparison | Pitch distillate | 97.5 | 82 | 38.5 | 14.6 | 24.5 | 2.40 | 61 |

TABLE-continued

| Example | Solvent | Properties of Coal By-Products | | | | | | |
|---|---|---|---|---|---|---|---|---|
| | | Yield (%) | SP(KS) (°C.) | TI (%) | QI (%) | Coke(BM) (%) | Ash (%) | Degree of coal digestion (%) |
| at 13 bars | | | | | | | | |

SP = softening point
KS = Krämer-Sarnow
QI = quinoline-insolubles
TI = toluene-insolubles
Coke(MB) = carbonization residue (Brockmann/Muck)

What is claimed is:

1. In a method for the production of a highly aromatic pitch-like coal by-product by dissolving comminuted coal or similar solid carbon-containing raw materials with aromatic solvents at elevated temperature, the improvement which comprises dissolving these solid materials at atmospheric pressure using as solvent aromatic compound mixtures of coal origin with a mean boiling point above 350° C. selected from the group consisting of standard coal tar pitch, distillates with a mean boiling range of 350° to 500° C. obtained in the heat/pressure treatment or carbonization of coal-tar pitch, and mixtures thereof, under reflux of the condensable fractions of the reaction gas.

2. The method according to claim 1 wherein further aromatic solvents are added to said solvent.

3. The method according to claim 1 wherein further aromatic solvents are added to said solvent.

4. The method according to claim 1, 3 wherein aromatic tar oils boiling below 350° C. are added as further solvents.

5. The method according to claim 1, 3 or 4 wherein residues from cracking and distillation processes of petroleum oil refining are admixed with the feedstock as further aromatic solvents.

6. The method according to claim 1 wherein 20–50% high-volatile coal in comminuted form is intimately mixed with 30–80% of solvent, and the suspension obtained is homogenized for from 1 to 3 hours in the temperature range of 280° to 380° C. at atmospheric pressure in an agitator retort under reflux of the condensable fraction of the reaction gas.

7. The method according to claim 1 wherein the coal used is a bituminous coal containing more than 30% volatile matter.

8. The method according to claim 7 wherein 10–35% further solvents are added to the suspension.

* * * * *